US006527647B2

(12) United States Patent
Ringeisen

(10) Patent No.: US 6,527,647 B2
(45) Date of Patent: Mar. 4, 2003

(54) POOL TRAINING DEVICE

(75) Inventor: Robert W. Ringeisen, Bulger, PA (US)

(73) Assignee: Judith I. Ringeisen, Bulger, PA (US)

( * ) Notice: Subject to any disclaimer, the term of this patent is extended or adjusted under 35 U.S.C. 154(b) by 47 days.

(21) Appl. No.: 09/872,104

(22) Filed: Jun. 1, 2001

(65) Prior Publication Data

US 2001/0051545 A1 Dec. 13, 2001

Related U.S. Application Data

(60) Provisional application No. 60/208,711, filed on Jun. 1, 2000.

(51) Int. Cl.[7] ..... A63D 15/00; G01B 1/00; G01C 15/00; A63B 37/00

(52) U.S. Cl. ..... 473/2; 473/52; 33/289; 33/506

(58) Field of Search ..... 473/1, 2, 52, 36, 473/37, FOR 1, FOR 2, FOR 52, FOR 36, FOR 37; 33/289, 286, 293, 506

(56) References Cited

U.S. PATENT DOCUMENTS 3,411,779 A * 11/1968 McGowan ..... 473/2
3,711,091 A * 1/1973 Dixon ..... 434/247
3,724,849 A * 4/1973 Pierce ..... 473/42
3,843,120 A * 10/1974 Ricci ..... 33/289
3,947,026 A * 3/1976 Scoutten ..... 33/289
4,157,805 A * 6/1979 Haber et al. ..... 473/52
4,178,694 A * 12/1979 Bonney ..... 33/289
4,268,033 A * 5/1981 Fontaine ..... 473/2
4,337,943 A * 7/1982 Stewart ..... 473/36
5,401,215 A * 3/1995 Pfost ..... 473/2
5,597,360 A * 1/1997 Freedenberg ..... 473/2
5,716,283 A * 2/1998 Simpson et al. ..... 473/2

* cited by examiner

*Primary Examiner*—Paul T. Sewell
*Assistant Examiner*—Mitra Aryanpour
(74) *Attorney, Agent, or Firm*—Webb Ziesenheim Logsdon Orkin & Hanson, P.C.

(57) ABSTRACT

The present invention is a pool training device, including a base configured to be placed on a pool tabletop surface, a mounting mechanism secured to the base, and a truncated circular element perpendicular to and attached to the base via the mounting mechanism. When attached, the height of the assembled device is equal to the height of a pool ball. The truncated circular element has an orifice extending perpendicularly through the center of the truncated circular element.

15 Claims, 3 Drawing Sheets

POOL TRAINING DEVICE

This patent application claims the benefit of U.S. provisional patent application 60/208,711, filed Jun. 1, 2000.

BACKGROUND OF THE INVENTION

1. Field of the Invention

The present invention relates generally to the game of pool and billiards, and, in particular, to a training device for use in aiming a shot in pool and billiards.

2. Description of the Prior Art

The game of pool and billiards has existed for many years and as access to tables increased, so has interest in the game. Further, this increased access allowed many novices entry into the market for pool and billiard tables and associated equipment, e.g., cue sticks, maintenance devices, reference books, magazines and other pool-related paraphernalia. Importantly, as one's interest increases, the desire to become a "skilled" player likewise increases. Besides understanding the basics of the game, there is a need for training aids and devices designed to assist a player in improving his or her game.

In order to alleviate this problem, a variety of training devices have been developed. For example, practice balls have been designed with a variety of markings printed directly on the ball, helping the user to strike the cue ball at a precise location on the ball. Cue guides have also been developed to assist the user in locating the tip of the cue at an appropriate distance from the table surface. In addition, "ghostball" trainers are available as a sticker or other flat arrow-marked device for laying on the surface of the table.

One drawback with these devices is their inability to assist in training the user to allow for the curvature of both the cue ball and the object ball. Further, using a training ball only aids in focusing the user on the location on the cue ball to strike, as opposed to focusing on the overall shot. Also, in using a flattened device, e.g., an "arrowed" sticker, the user may have difficulty viewing the device from all angles of the table, and the user cannot effectively use the "ghostball" device if actual balls are placed on the sticker, covering the arrow. All of these training aids require considerable visualization and mental "gymnastics" before they are useful in training.

The present invention provides a pool training device which assists the user in focusing upon the correct strike points on both the cue ball and the object ball. It also assists in understanding the geometry and skill involved in aiming at the correct spot on a curved object ball surface. The present invention is viewable from all angles of the table, is useable with actual pool balls, and reduces the amount of mental effort involved in focusing and performing mental calculations prior to each shot.

SUMMARY OF THE INVENTION

Accordingly, I have invented a pool training device that includes: a base with a mounting mechanism attached to the center of the base; a truncated circular target rotatably mounted on the mounting mechanism perpendicular to the base; and an orifice in the center of the truncated circular target. Both the base and the circular target are the diameter (or width) of a pool ball and are constructed of a material that is clear in nature, e.g., plexiglass. The mounting mechanism is preferably a mounting pin, which extends away from the center of the circular base.

In operation, the user places the base next to the object ball (i.e., the ball that is to be contacted and pushed into the pocket). Next, the user rotates the truncated circular target so that an edge of the target is directionally aligned with the center of the pocket via the bisecting line on the object ball. In this manner, one focal line is created joining the edge of the truncated circular target, the center bisecting line of the object ball and the center of the pocket. Once aligned, the user rotates the truncated circular target so that the user can view a point on or near the object ball through the orifice. The user then creates a line between the end of the cue stick, the imaginary line running through the end of the cue stick, through and perpendicular to the orifice to a focal point on or near the object ball. Once this point is viewed and realized, the pool training device may be removed, and the user may continue to focus on the focal point. The user then strikes the cue ball in the direction of the focal point, striking the object ball and pushing the object ball into the pocket. The more often the user uses the pool training device, he or she eventually instinctually finds the correct focal point, obviating the need for the pool training device. Overall, the pool training device provides training for understanding the geometry and focusing skills necessary to master the game.

The present invention, both as to its construction and its method of operation, together with additional objects and advantages thereof, will best be understood from the following description of specific embodiments when read in connection with accompanying drawings.

DETAILED DESCRIPTION OF THE PREFERRED EMBODIMENT

Figure 1:
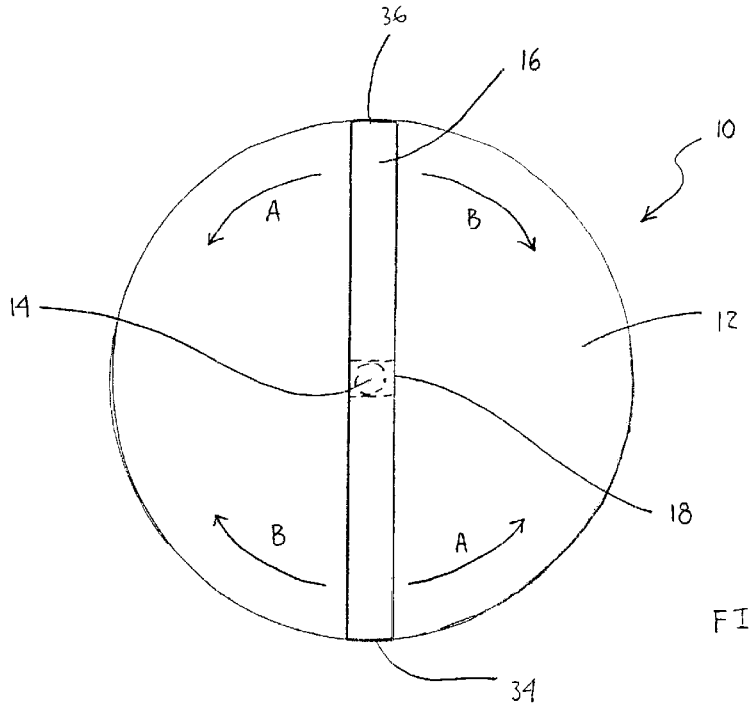
FIG. 1 is a top plan view of a pool training device according to the present invention.
Figure 2:
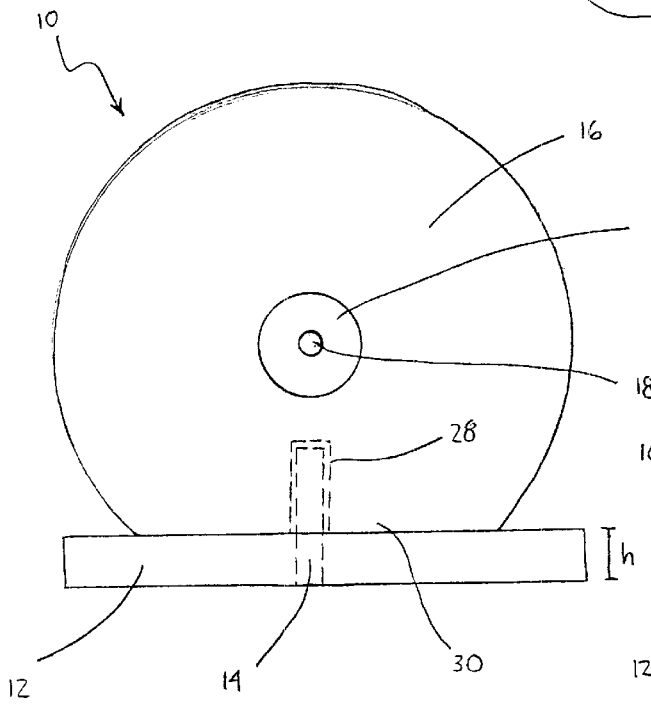
FIG. 2 is a side elevational view of the pool training device in FIG. 1.
Figure 3:
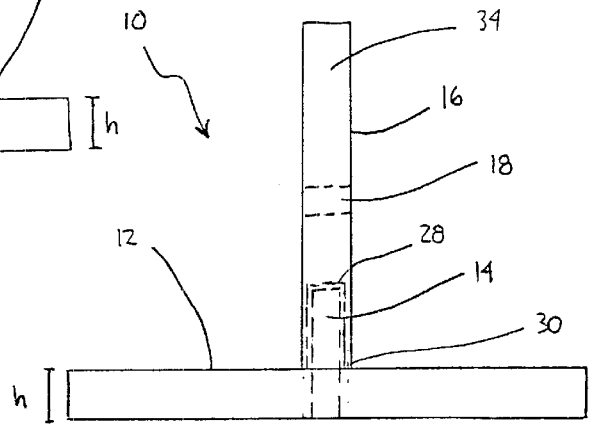
FIG. 3 is an edge elevational view of the pool training device in FIG. 1.

A pool training device 10 according to the present invention is generally shown in FIGS. 1–3. The pool training device 10 includes a base 12, typically circular, with a centrally located mounting pin 14, a truncated circular target 16 and an orifice 18 extending through the center of the truncated circular target 16. Both the base 12 and the truncated circular target 16 are constructed of a durable, clear material, such as plexiglass, plastic, glass, or other suitable material.

The base 12 is a flat, circular element with a height h and is adapted to be placed on a felt tabletop 20 of a pool or billiard table 22. The diameter of the base 12 is equal to the diameter of a typical cue ball 24 or object ball 26. Secured to the center of the base 12 and extending perpendicularly away from the base 12 is the mounting pin 14. The mounting pin 14 may be glued or otherwise fixed to the central point on the base 12 or, alternatively, may be frictionally inserted into and engage a matching orifice drilled through the center of the base 12. Regardless of the method of fixation, the mounting pin 14 must be stationary with respect to the base 12.

The truncated circular target 16 is a flat, circular element and includes a truncated portion at a base 30 of the truncated circular target 16 and two edges 34 and 36. As with the base 12, the truncated circular target 16 has the same diameter as the cue ball 24 or object ball 26. The truncated circular target 16 is constructed so that the height of the truncated portion coincides exactly with the height h of the base 12. Further, the truncated circular target 16 is perpendicular to and rotatably attached to base 12 via the mounting pin 14. This may be accomplished by drilling a mounting orifice 28 through the center of the base 30 of the truncated circular target 16, with the mounting orifice 28 allowing a flat, truncated portion of the truncated circular target 16 to rest upon the base 12. The truncated circular target 16 is rotatably connected to the stationary mounting pin 14 by placing the mounting orifice 28 over the mounting pin 14. As shown in FIG. 1, the truncated circular target 16 is rotatable in either direction A or B.

FIG. 2 shows the orifice 18 extending perpendicularly through the center of truncated circular target 16. This orifice 18 must be positioned at the exact center point of the truncated circular target 16, equidistant from each point on the curved portion of the truncated circular target 16. It is also envisioned that a focusing aid 32 may be used around the circumference of the orifice 18, assisting the user in focusing through the orifice 18. This focusing aid 32 may be a sticker or a decal applied to the pool training device 10 during or after manufacture.

Once the truncated circular target 16 is rotatably mounted on the mounting pin 14, the assembled pool training device 10 has the same width, height and diameter of the cue ball 24 or object ball 26. As the user rotates the truncated circular target 16 around the base 12, which is itself resting upon the felt tabletop 20, the pool training device 10 appears as a see-through pool ball with a central focal point.

Figure 4:
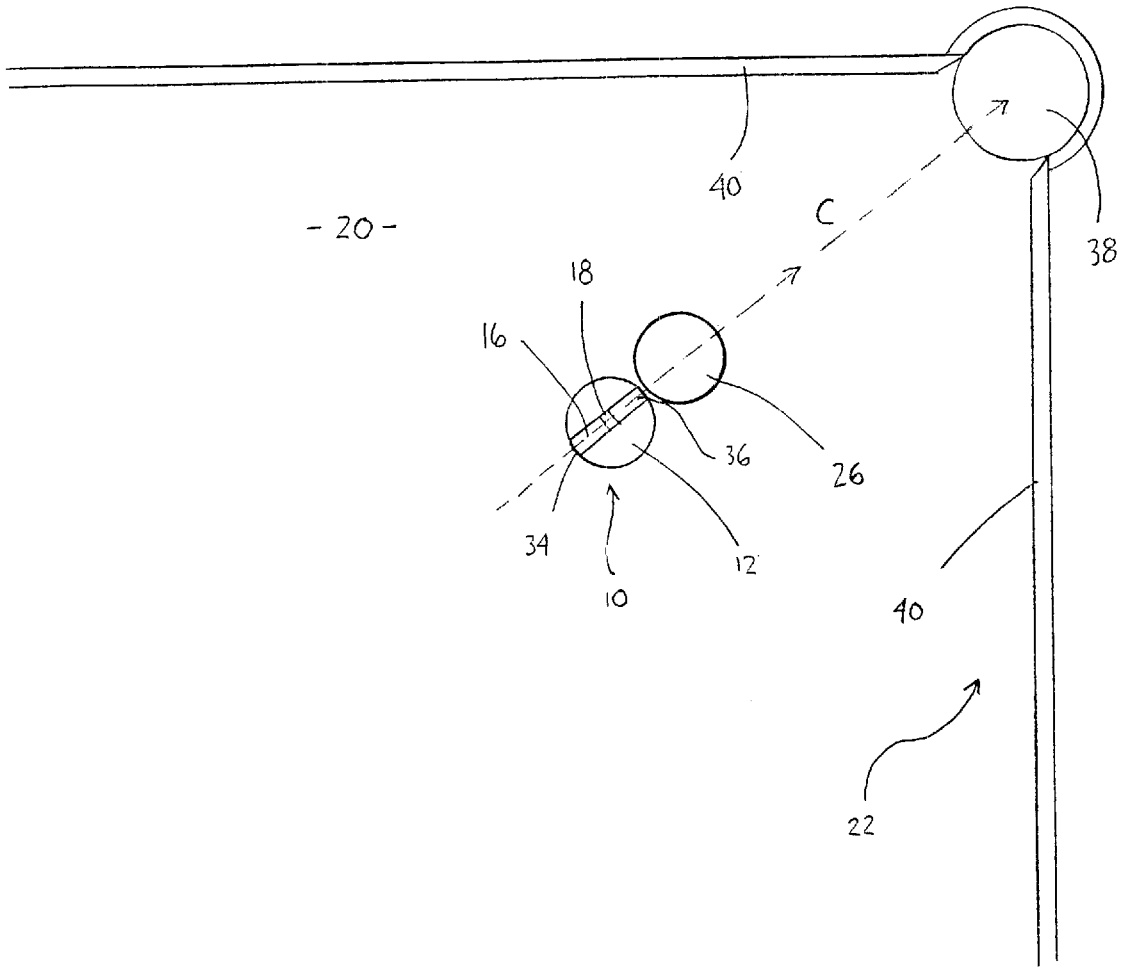
FIG. 4 is an illustration of the pool training device in FIG. 1 in a first step of use.

As shown in FIG. 4, in operation, the user places the pool training device 10 immediately adjacent the object ball 26. Next, the user rotates the truncated circular target 16 so that line-of-sight vector C is created through the first edge 34 of the truncated circular target 16, the second edge 36 of the truncated circular target 16, the bisecting diameter of the object ball 26 and a center of the pocket 38. Generally, the user should use the edges 34 and 36 to create a vector that joins edges 34 and 36, the bisecting diameter of the object ball 26 and the object point, whether it is the pocket 38, a rail 40, or another ball.

Figure 5:
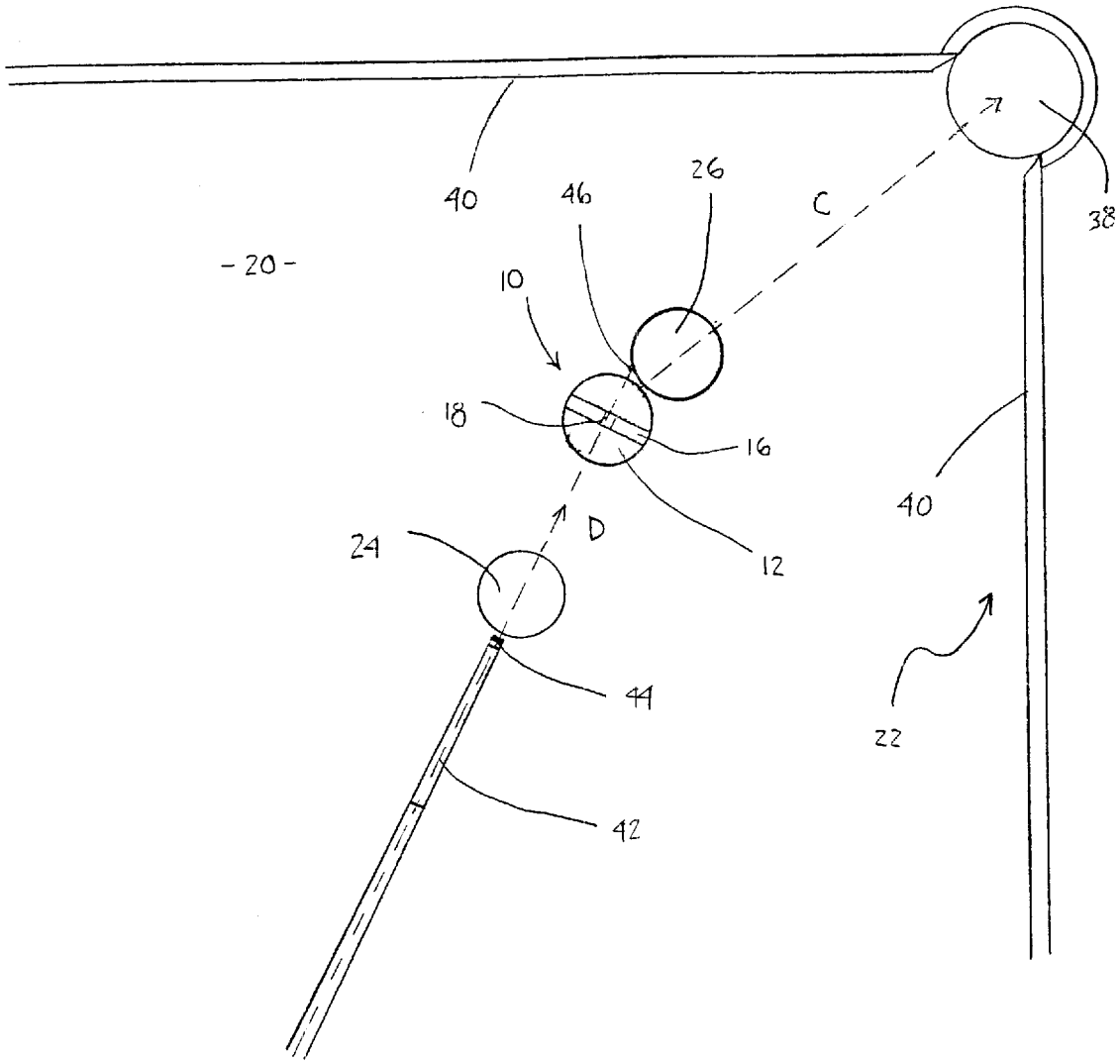
FIG. 5 is an illustration of the pool training device in FIG. 1 in a second step of use.

When this step is completed, as shown in FIG. 5, the user rotates the truncated circular target 16 creating line-of-sight vector D. Line-of-sight vector D is created through a cue stick 42 and a cue stick tip 44, the bisecting diameter of the cue ball 24 and the center of the central orifice 18. At the cue stick 42 level, the user may look through orifice 18 to a focal point 46 on or near the object ball 26. Once the user establishes focal point 46, the pool training device 10 may be removed from the pool or billiard table 22. The user then strikes the cue ball 24 along line-of-sight vector D, striking the object ball 26 and pushing object ball 26 along line-of-sight vector C into the pocket 38.

The user may repeat this process with each shot during a training session, learning to judge the correct focal point 46 on or near the object ball 26. Also, different spots on the cue ball 24 or object ball 26 may be struck for the addition of spin to the cue ball 24 or object ball 26, but still completing line-of-sight vector D and line-of-sight vector C. After continual use, the user will eventually train his or her mind and eye to appropriately adjust for the curvature of the cue ball 24 and the object ball 26 with minimal forethought. Pool training device 10 assists the user in understanding the geometry and skill involved in aiming at the correct spot on a curved object ball surface. In addition, the present invention 10 is easily viewed from any angle on the table and is useable with actual pool balls.

This invention has been described with reference to the preferred embodiment. Obvious modifications and alterations will occur to others upon reading and understanding the preceding detailed description. It is intended that the invention be construed as including all such modifications and alterations.

I claim:

1. A pool training device comprising:

a base configured to be placed on a pool table top surface;

a mounting mechanism secured to the base; and a truncated circular element perpendicular to and rotatably attached to the base via the mounting mechanism such that, when attached, the height of the assembled device is equal to the height of a pool ball, the truncated circular element having an orifice extending perpendicular through the center of the truncated circular element.

2. The pool training device of claim 1, wherein the base and truncated circular element are constructed from a substantially transparent material.

3. The pool training device of claim 2, wherein the substantially transparent material is one of plexiglass, plastic and glass.

4. The pool training device of claim 1, wherein the mounting mechanism is a mounting pin.

5. The pool training device of claim 4, wherein the mounting pin is attached to the central point of the base via an adhesive.

6. The pool training device of claim 4, further comprising a base mounting orifice located at the central point of the base and configured to accept the mounting pin therein, such that the mounting pin is stationery with respect to the base.

7. The pool training device of claim 1, wherein the truncated circular element has a diameter equal to the diameter of the pool ball.

8. The pool training device of claim 1, further comprising a truncated circular element mounting orifice extending partially through a center of a lower edge of the truncated circular element, wherein the mounting mechanism is a mounting pin secured to the center of the base and extending perpendicularly away from the base, such that the truncated circular element mounting orifice may be placed over the mounting pin, thereby allowing the truncated circular element to rest upon the base.

9. The pool training device of claim 8, wherein the truncated circular element is rotatably connected to the mounting pin by placing the truncated circular element mounting orifice over the mounting pin.

10. The pool training device of claim 1, further comprising a focusing aid attached to the truncated circular element and surrounding the circumference of the truncated circular element central orifice, such that the focusing aid assists a user in focusing through the orifice.

11. The pool training device of claim 10, wherein the focusing aid is a sticker that is adherable to the pool training device.

12. The pool training device of claim 1, wherein the base is circular.

13. A method of training a pool player, comprising the steps of:

providing a base configured to be placed on a pool tabletop surface, a mounting mechanism secured to the base, and a truncated circular element perpendicular to and rotatably attached to the base via the mounting mechanism, wherein the truncated circular element has an orifice extending perpendicularly through the center of the truncated circular element;

placing the pool training device immediately adjacent an object ball;

rotating the truncated circular element so that a first line-of-sight vector is created through a first edge of the truncated circular element, a second edge of the truncated circular element, a bisecting diameter of the object ball and a center of an object point;

rotating the truncated circular element, thereby creating a second line-of-sight vector through a cue stick, a cue stick tip, a bisecting diameter of a cue ball and a center of the central orifice;

establishing a focal point through the central orifice;

removing the pool training device from the pool table; and striking the cue ball along the second line-of-sight vector, thereby striking the object ball and pushing the object ball along the first line-of-sight vector directly towards the object point.

14. The method of training a pool player according to claim 13, wherein the object point is one of a pool table pocket, a pool table rail and another pool ball.

15. A pool training device comprising:

a circular base configured to be placed on a pool tabletop surface;

a mounting pin attached to the central point of the circular base;

a circular base mounting orifice located at the central point of the circular base and configured to accept the mounting pin therein, such that the mounting pin is stationary with respect to the circular base; and a truncated circular element having a truncated circular element mounting orifice extending partially through a center of the base of the truncated circular element, wherein the truncated circular element mounting orifice may be placed over the mounting pin, thereby allowing the truncated circular element to rest upon the circular base, wherein the truncated circular element is rotatably connected to the circular base via the mounting pin and has an orifice extending perpendicularly through the center of the truncated circular element.

* * * * *